US006298631B1

(12) United States Patent
Finley

(10) Patent No.: US 6,298,631 B1
(45) Date of Patent: Oct. 9, 2001

(54) WINDOW WELL CLIP

(76) Inventor: Todd Finley, 3708 S. Waco St., Aurora, CO (US) 80013

( * ) Notice: Subject to any disclaimer, the term of this patent is extended or adjusted under 35 U.S.C. 154(b) by 0 days.

(21) Appl. No.: 09/356,672

(22) Filed: Jul. 19, 1999

(51) Int. Cl.[7] ..... E04B 1/00

(52) U.S. Cl. ..... 52/742.15; 52/107; 52/712; 52/714; 52/699; 249/39; 249/219.1; 248/208; 248/231.9; 248/300

(58) Field of Search ..... 52/107, 712, 714, 52/699, 742.15; 248/208, 231.9, 300; 249/39, 219.1

(56) References Cited

U.S. PATENT DOCUMENTS

| | | | | |
|---|---|---|---|---|
| 113,388 | * | 4/1871 | Bender | 249/39 |
| 1,251,274 | * | 12/1917 | Patridis | 52/107 |
| 2,453,609 | * | 11/1948 | Whitehouse | 249/39 |
| 3,004,634 | * | 10/1961 | Evans et al. | 52/169.1 |
| 3,276,179 | * | 10/1966 | Rallis | 249/39 |
| 3,276,180 | * | 10/1966 | Westinghouse | 249/39 |
| 4,320,888 | * | 3/1982 | Oury | 249/219.1 |
| 4,393,568 | * | 7/1983 | Navarro | 248/300 |
| 5,169,544 | * | 12/1992 | Stanfill et al. | 249/39 |
| 5,496,006 | * | 3/1996 | Kulka et al. | 248/231.9 |
| 5,623,791 | * | 4/1997 | Schwarz | 52/107 |
| 6,065,730 | * | 5/2000 | Marks et al. | 248/314 |

* cited by examiner

*Primary Examiner*—Carl D. Friedman
*Assistant Examiner*—Dennis L. Dorsey

(57) ABSTRACT

A method for attaching a window well to the outer surface of a window opening. The method includes providing a window well mold, and providing a window well clip for use with the mold, the clip having a first face and a second intersecting face. An opening is provided in the first face for receiving a bolt, with a sheath aligned with the opening. A support member is provided extending between the two faces to provide rigidity for the well clip. Means are provided for removably attaching the clip to the window mold, and the clip is attached to the mold to form a mold-clip assembly. The assembly is next set in fresh concrete with the first face flush with the outer surface of the window opening. After the concrete is hardened, the mold is removed, leaving the clip embedded in the concrete. A bolt is then provided and inserted into the first face opening, attaching the bolt to the window well, and tightening the bolt into the sheath.

1 Claim, 3 Drawing Sheets

WINDOW WELL CLIP

TECHNICAL FIELD

This invention relates to devices for attaching window wells to buildings, and more particularly, to a window well clip to be utilized with a removable window mold for attaching a window well to a building.

BACKGROUND ART

The use of window wells around windows in houses-and in buildings is well known. Generally, two different methods have been used to attach window wells to the area of the building surrounding the windows. The choice of which attachment method to use has typically depended upon the type of window mold used to form the window opening itself. Two broad types of window molds are used in forming window openings: permanent window molds and removable window molds.

Permanent window molds are molds which remain permanently embedded in the concrete which was poured around the mold to form the window opening. In other words, the permanent window mold actually becomes a part of the building itself. When permanent window molds are used, the molds themselves often have clips or brackets built into the mold. Window wells may then be bolted directly to the clips or brackets to attach the window wells to the area around the window. This method is very effective, but it is expensive to utilize because each window opening requires its own mold.

In order to avoid the costs of using a permanent mold for each individual window opening, removable molds are sometimes used. Removable molds are designed so that concrete may be poured around the molds, and the molds may then be removed after the concrete has set. Clearly, this is cheaper than using permanent molds, as a single mold may be used to form a large number of window openings. However, conventional use of removable molds leaves unsolved the problem of attaching the window well to the building. This attachment has typically been accomplished by using a nail gun to nail the window well to the concrete, or by use of a drill to create holes in the concrete to allow bolting the window wells to the concrete. Drilling holes in concrete or use of nail guns to attach window wells to concrete is difficult and time-consuming. There is thus a need for an approach which provides the simplicity and ease of use of permanent molds, with the cost effectiveness of removable molds.

DISCLOSURE OF THE INVENTION

In accordance with this invention a window well clip is provided for use with a removable window mold which forms a window opening when concrete is poured around the mold and the mold is removed. The clip includes a first face and a second face intersecting with the first face, typically at an obtuse angle. The clip has a hole in the first face for receiving a bolt, with a protective sheath aligned with the hole for receiving a bolt. A boss is provided for removably attaching the clip to the window mold such that when the window mold is removed from the set concrete the clip remains embedded in the concrete to allow attachment of a window well to the clip. Attachment is accomplished by backing out the bolt from the clip, inserting the bolt into a slot on the window well, and then tightening down the bolt to secure the window well in place against the building.

In veiw of the foregoing, several advantages of the s present invention are readily apparent. A window well clip is provided which is cheap and yet effective in attaching a window well to the area around a window. The clip is easy to use, especially when compared to conventional methods of nailing or bolting window wells directly to concrete. The clip is as easy to use and as effective as conventional brackets built into permanent window molds, yet costs only a fraction of the cost of a permanent mold to use.

Additional advantages of this invention will become apparent from the description which follows, taken in conjunction with the accompanying drawings.

BEST MODE FOR CARRYING OUT THE INVENTION

Figure 1:
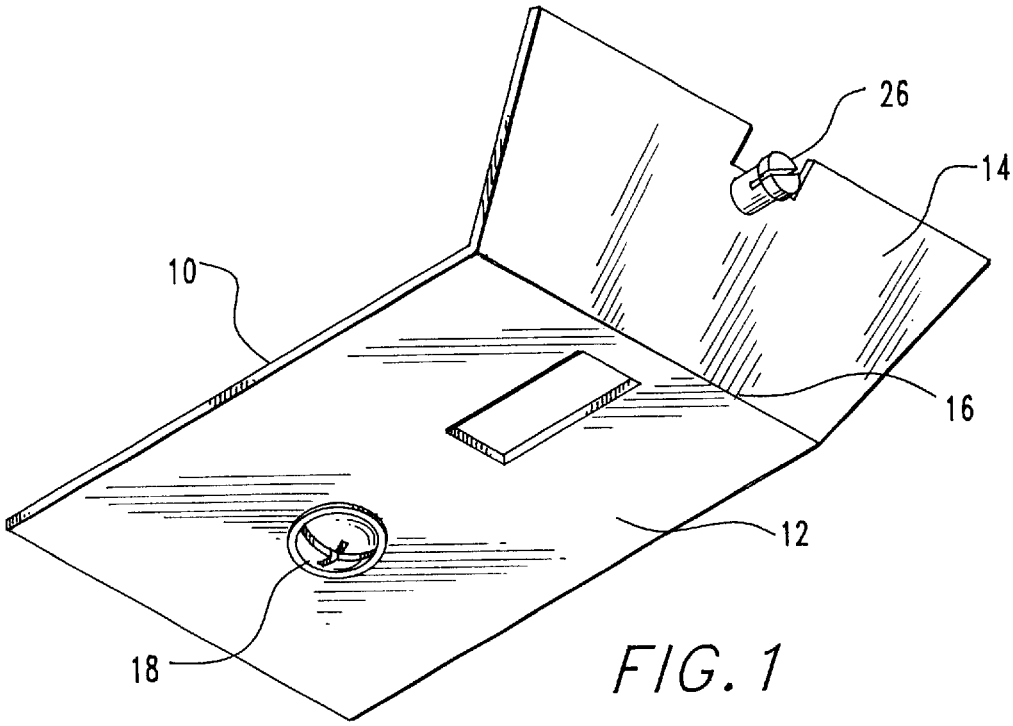
FIG. 1 is a perspective view of the window well clip showing the outer surfaces of the clip.
Figure 2:
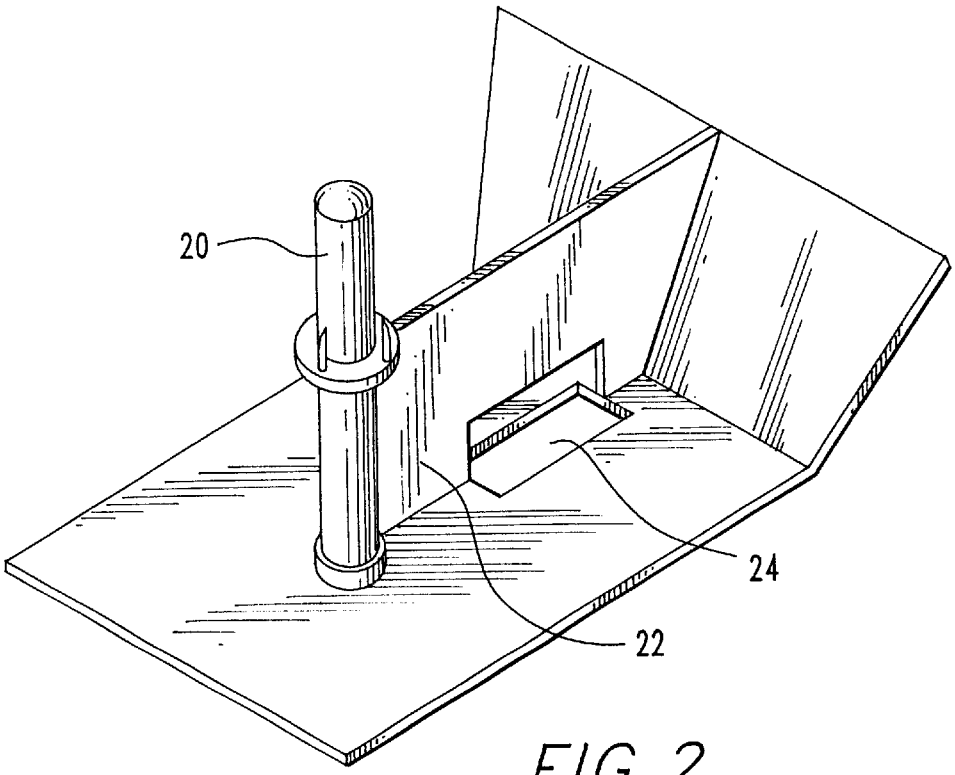
FIG. 2 is a perspective view of the window well clip showing the inner structure of the clip.

Referring now to the drawings, particularly FIGS. 1 and 2, there is shown a window well clip 10 having a first face 12 and a second face 14 intersecting with the first face at an obtuse angle 16. A threaded mounting bolt 18 is contained within threaded bolt sheath 20. Support member 22 is connected to the first face 12 and extends between the second face 14 and the bolt sheath 20 to provide rigidity of structure to the well clip 10. An aperture 24, called a "lock," is located in the first face 12, preferably somewhere near the center of that face. Boss 26 is provided to allow the clip 10 to be quickly and easily attached to a window mold having a corresponding snap-in hole. The window well clip 10 is preferably made of hard plastic, although any suitable rigid material might also be used. However, hard plastic is generally the most practical and economical to use.

Figure 3:
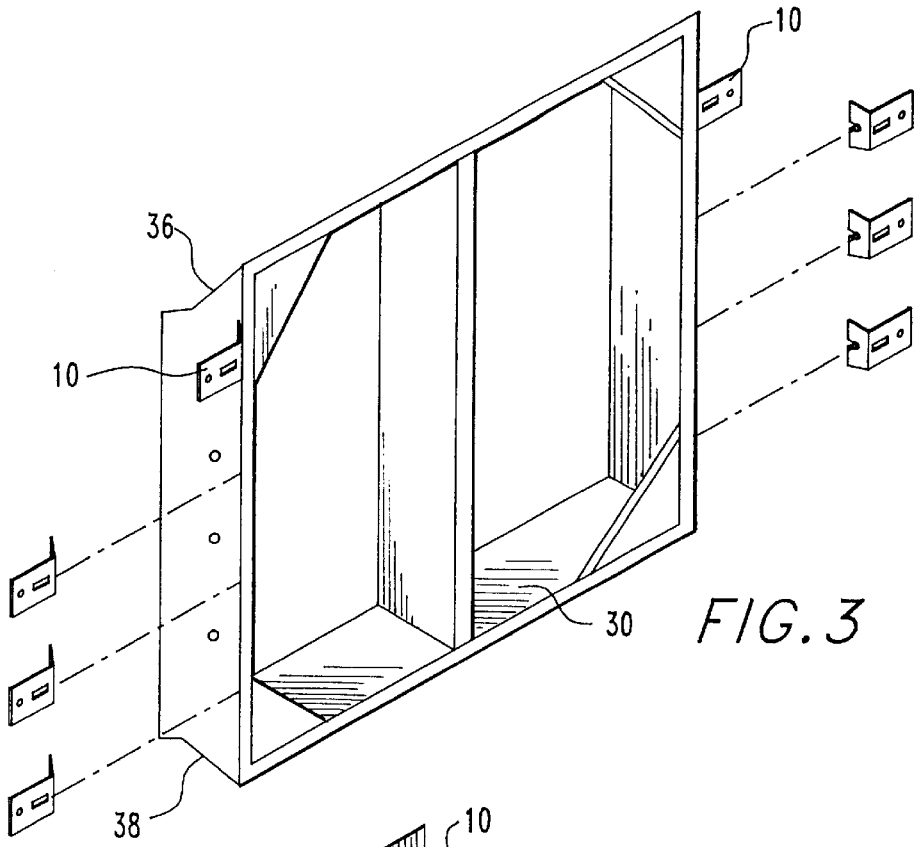
FIG. 3 is a perspective view of a removable window mold showing the attachment of the clips to the mold.
Figure 4:
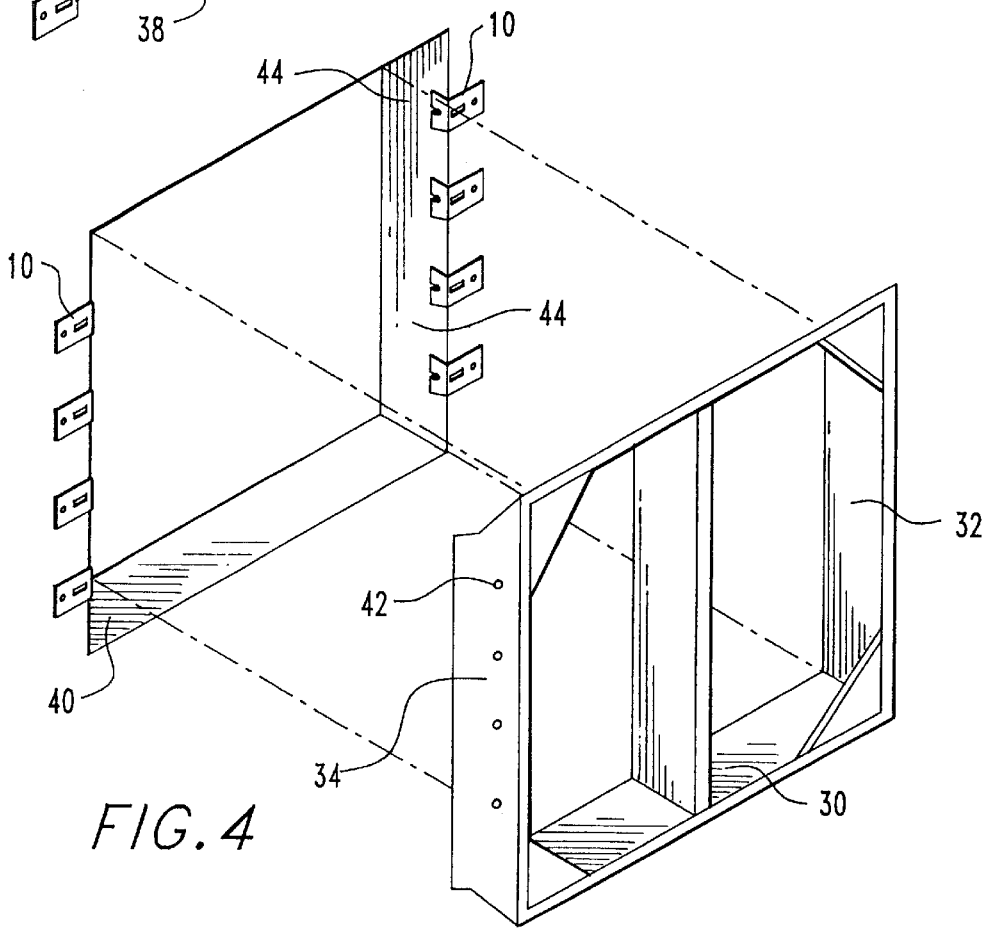
FIG. 4 is a perspective view of a window mold and window opening, with the clips remaining in place around the window opening after removal of the mold.

Referring now to FIGS. 3 and 4, use of the clip 10 with a removable window mold 30 is shown. The sides 32,34 of window mold 30 are tapered, as may be seen by observing edges 36,38. This allows the mold 30 to be removable after concrete has been poured around it and has set, thereby leaving a window opening frame 40. The window well clip 10 is attached to the window mold 30 by inserting boss 26 into a corresponding hole 42 in the side of the mold 30. The boss 26 fits snugly into the hole 42, to hold the clip firmly in place on the window mold 30. As may also be seen in FIG. 6, several clips are typically used on each side of the mold 30. The most common number of clips used is four per side, although more or less may be used depending upon the desired results. In practice, the clip 10 is first attached to the window mold 30 as described above. Concrete is then poured around the mold and allowed to harden, which firmly secures the clip 10 in the concrete. When concrete is poured around the clip, a certain amount of concrete will flow through the lock 24, thereby acting to anchor the clip more firmly in place. The mold is then removed by pulling it outward, and leaving the window opening frame 40 as shown. As the mold 30 is pulled out, the bosses 26 are sheared off, leaving the clips 10 remaining in the concrete. The clips 10 have been aligned such that the first face 12 of each is flush with the exterior wall surrounding the window opening frame 40, while the second clip face 14 is flush with the inner side 44 of the window opening frame 40.

Figure 5:
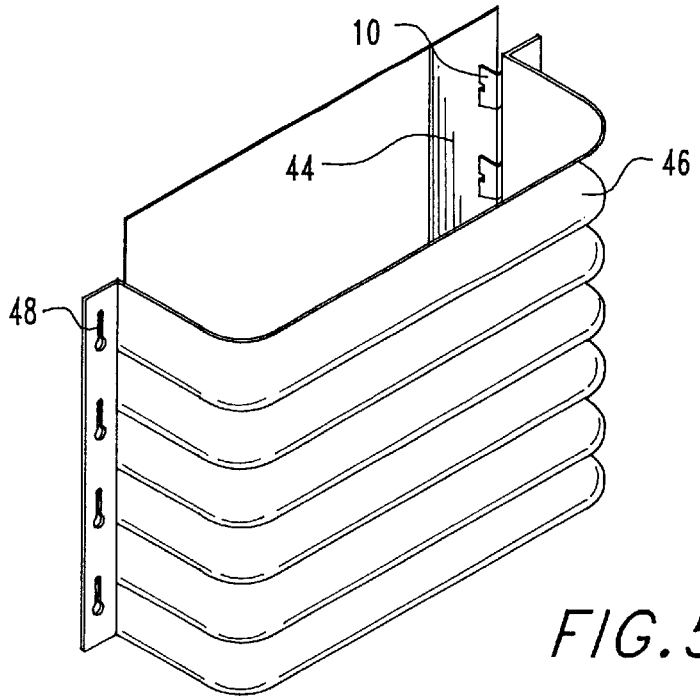
FIG. 5 is a perspective view of a window well attached to a window opening using the window well clip of the present invention.
Figure 6:
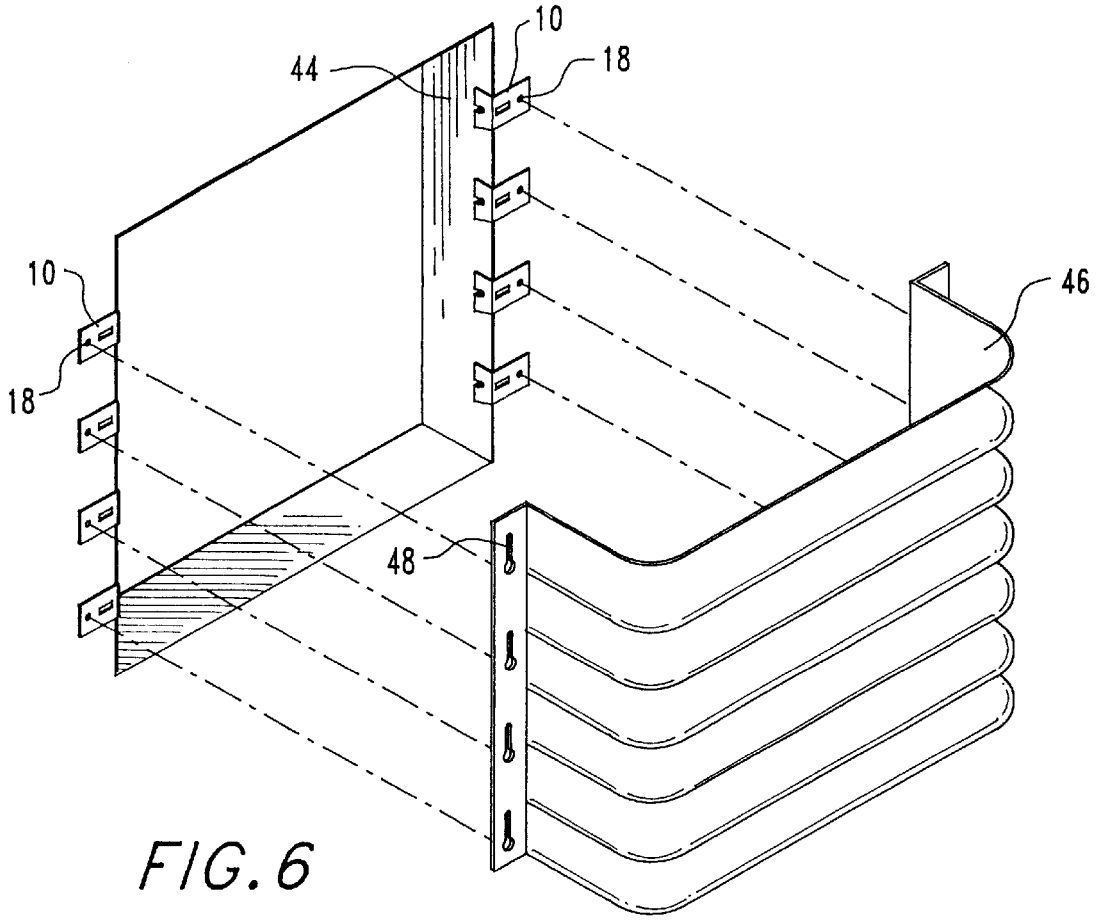
FIG. 6 is an exploded view of FIG. 5.

Referring now to FIGS. 5 and 6, it may be seen how the clips 10 are used to attach a window well 46 to the wall surrounding the window opening frame 40. FIG. 5 shows the window well actually in place, while FIG. 6 is an exploded view of FIG. 5, showing in more detail how the window well is attached to the clips 10 surrounding the window opening frame 40.

In practice, after the concrete is set and the mold 30 has been removed, the bolts 18(A-H) are first partially unscrewed to back them out of sheaths 20. Corresponding slots 48 and window well 46 are then fitted over bolts 18(A–H), and the bolts are tightened down to fix the window well in place.

Based on the above description, several advantages of this invention may be easily seen. The window well clip is cost-effective and yet efficient in attaching a window well to a building. The clip is simple and easy to use, particularly when compared to conventional methods of nailing or bolting window wells directly to set concrete. The clip is as easy to use and as effective as conventional brackets built into permanent window molds, while costing only a fraction of the cost of using permanent molds.

This invention has been described in detail with reference to a particular embodiment thereof, but it will be understood that various other modifications can be effected within the spirit and scope of this invention.

What is claimed is:

1. A method for attaching a window well to the outer surface of a window opening, comprising the steps of:

(a) providing a removable window well mold, which mold forms a window opening when concrete is poured around the mold and allowed to set and the mold is then removed;

(b) providing a window well clip for use with said mold, said clip having a first face and a second face intersecting with said first face;

(c) providing an opening in said first face for receiving a bolt;

(d) providing a protective sheath for receiving a bolt, said sheath being aligned with said opening in said first face;

(e) providing a support member connected to said first face and extending between said second face and said sheath to provide rigidity of structure to the well clip;

(f) providing means for removably attaching said clip to the window mold;

(g) attaching said clip to said mold to form a mold-clip assembly;

(f) setting said mold-clip assembly in fresh concrete, with said first face aligned to be flush with the outer surface of the window opening;

(h) allowing the concrete to harden to form a window opening frame;

(f) removing said window mold from said window opening frame and from said window well clip, leaving said clip embedded in said concrete;

(g) providing a bolt for bolting said window well to said window frame opening; and (h) securing the window well in place by inserting said bolt through said first face opening into said protective sheath, attaching said bolt to said window well, and tightening said bolt into said sheath.

* * * * *